US010925396B2

(12) United States Patent
Murphy et al.

(10) Patent No.: US 10,925,396 B2
(45) Date of Patent: Feb. 23, 2021

(54) STORAGE CABINET HAVING A POWERED MOVEMENT SYSTEM

(71) Applicant: Kohler Co., Kohler, WI (US)

(72) Inventors: Roger W. Murphy, Kohler, WI (US); Alexander V. LeTourneau, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 295 days.

(21) Appl. No.: 15/985,403

(22) Filed: May 21, 2018

(65) Prior Publication Data

US 2019/0350360 A1 Nov. 21, 2019

(51) Int. Cl.

| | |
|---|---|
| ***A47B 67/00*** | (2006.01) |
| ***A45D 42/10*** | (2006.01) |
| ***A47B 67/02*** | (2006.01) |
| ***E06B 3/44*** | (2006.01) |
| ***A47G 1/24*** | (2006.01) |
| ***A47G 1/00*** | (2006.01) |

(Continued)

(52) U.S. Cl.

CPC ..... *A47B 67/005* (2013.01); *A45D 42/10* (2013.01); *A47B 67/02* (2013.01); *A47G 1/24* (2013.01); *E06B 3/443* (2013.01); *A47G 2001/007* (2013.01); *F21S 10/02* (2013.01); *F21V 33/004* (2013.01)

(58) Field of Classification Search

CPC ..... A47B 67/005; A47B 67/02; A47B 67/00; A45D 42/10; E06B 3/443; E06B 3/44; F21V 33/004

See application file for complete search history.

(56) References Cited

U.S. PATENT DOCUMENTS

| | | | |
|---|---|---|---|
| 367,597 | A | 8/1887 | Clingman |
| 1,612,100 | A | 12/1926 | Dailey |

(Continued)

FOREIGN PATENT DOCUMENTS

| | | | |
|---|---|---|---|
| CN | 108166896 | A * | 6/2018 |
| CN | 208294314 | U * | 12/2018 |

(Continued)

OTHER PUBLICATIONS

Machine translation of CN 108166896 A (Year: 2020).*
Machine translation of CN 208294314 U (Year: 2020).*

*Primary Examiner* — Daniel J Rohrhoff
(74) *Attorney, Agent, or Firm* — Lempia Summerfield Katz LLC

(57) ABSTRACT

A storage cabinet is disclosed. The storage cabinet includes a housing, a movement system and a computing device. The housing includes a plurality of walls and a door. The walls and door define an internal storage cavity. The movement system is operatively connected to the door and configured to control vertical movement of the door. The movement system is configured to move the door between, at least, a fully closed and fully open position based on inputs provided by a user. The computing device is operatively connected to the movement system. The computing device includes a processor and memory. The memory stores instructions that, when executed by the processor, cause the processor to receive an input from a user, and generate control signal(s) for the movement system based on the input from the user. The control signals cause the movement system to move the door into a different position.

20 Claims, 6 Drawing Sheets

(51) Int. Cl.
*F21V 33/00* (2006.01)
*F21S 10/02* (2006.01)

(56) References Cited

U.S. PATENT DOCUMENTS 1,772,877 A 8/1930 Rosener
2,331,655 A 10/1943 Colwill
2,773,728 A * 12/1956 La Barre ..... A47B 67/02 312/227
2,877,687 A 3/1959 Bozin
3,018,690 A 1/1962 Magrauth
3,353,885 A 11/1967 Handson
3,353,887 A 11/1967 Cihlar
4,339,104 A 7/1982 Weidman
4,396,249 A 8/1983 Aisley
4,688,861 A 8/1987 Culver
9,103,980 B2 8/2015 Gipson
9,675,172 B2 6/2017 Pandorf
9,686,673 B2 6/2017 Swedenburg
9,879,467 B2 * 1/2018 Hasselback ..... H04N 5/2251
10,487,560 B2 * 11/2019 Kempfle ..... G05B 15/02
2009/0033189 A1 * 2/2009 Glanz ..... E05F 15/63 312/405
2010/0270438 A1 * 10/2010 Pandorf ..... A47B 67/02 248/65
2016/0255941 A1 9/2016 Yang et al.
2017/0038058 A1 * 2/2017 Cano ..... F21V 33/0012
2017/0099945 A1 * 4/2017 Meads ..... A47B 67/005
2017/0181541 A1 * 6/2017 Stanley, Jr. ..... H02J 7/0042
2017/0322389 A1 11/2017 Hagestad et al.
2018/0305970 A1 * 10/2018 Whitmire ..... E06B 3/44
2020/0102781 A1 * 4/2020 Amacker ..... H02J 50/90

FOREIGN PATENT DOCUMENTS

DE 2227457 12/1973
DE 9006103 8/1990
EP 1193362 4/2002
EP 2626493 A1 * 8/2013 ..... E05D 15/165
GB 171457 11/1921

* cited by examiner

STORAGE CABINET HAVING A POWERED MOVEMENT SYSTEM

BACKGROUND

The present application relates generally to medicine cabinets and vanities typically used in bathroom and other environments.

Medicine cabinets and vanities (collectively "storage cabinets") are often used in bathrooms. Such storage cabinets may include a mirrored door which conceals an internal storage cavity. The mirrored door is typically coupled to the storage cabinet via hinges such that the door pivots open and shut.

A user may use the mirror while getting ready. However, such use limits the access of the contents of the internal storage cavity (since the mirrored door will need to be closed for the user to use the mirror). Conversely, where a user accesses the contents of the internal storage cavity by pivoting the mirrored door open, the user will not be able to use the mirror.

Furthermore, every time the user opens and closes the door, the user is typically required to touch various surfaces of the door. As a result, mirrors in bathrooms are often smudged, thus requiring frequent cleaning.

It may therefore be advantageous to include a mirrored door that moves upwardly such that a user can both access the internal storage cavity and, at the same time, use the mirror. Furthermore, it may be advantageous to motorize the upward movement so as to prevent touching of the mirrored door. The present application discusses an improved mirror that includes lighting features and a method for assembling such a mirror.

SUMMARY

One embodiment of the disclosure relates to a storage cabinet. The storage cabinet includes a housing including a plurality of walls and a door. The plurality of walls and the door define an internal storage cavity. The storage cabinet includes a movement system operatively connected to the door and configured to control movement of the door. The movement system is configured to move the door between a fully closed position and, at least, a fully open position based on inputs provided by a user. The storage cabinet includes a computing device operatively connected to the movement system. The computing device includes a processor and memory. The memory stores instructions that, when executed by the processor, cause the processor to receive an input from a user, and to generate one or more control signals for the movement system based on the input from the user. The one or more control signals cause the movement system to move the door into a different position.

Another embodiment of the disclosure relates to a storage cabinet. The storage cabinet includes a housing including a plurality of walls and a mirrored door. The plurality of walls and the mirrored door define an internal storage cavity. The storage cabinet includes a pair of opposing mirrored wings coupled to opposing sides of the housing. The storage cabinet includes a movement system configured to control planar movement of the mirrored door with respect to the internal storage cavity. The movement system is configured to move the mirrored door between a fully closed position and, at least, a fully open position. The storage cabinet includes a computing device comprising a processor and memory. The memory stores instructions that, when executed by the processor, cause the processor to receive an input from a user to move the mirrored door into a different position than a current position of the mirrored door. The memory further stores instructions to generate one or more control signals for the movement system to move the mirrored door from the current position towards the different position.

Another embodiment of the disclosure relates to a storage cabinet. The storage cabinet includes a housing including a plurality of walls and a mirrored door. The plurality of walls and the mirrored door define an internal storage cavity. The storage cabinet includes a pair of opposing mirrored wings coupled to opposing sides of the housing. Each of the mirrored wings includes a respective controllable light source. The storage cabinet includes a movement system operatively connected to the door and configured to control planar movement of the door. The movement system is configured to move the door between a fully closed position and, at least, a fully open position based on inputs provided by a user. The storage cabinet includes a computing device communicably coupled to the controllable light sources and the movement system. The computing device includes a processor and memory. The memory stores instructions that, when executed by the processor, cause the processor to receive an input from the user. The memory further stores instructions to determine whether the input pertains to the movement system or the controllable light sources. The memory further stores instructions to generate one or more movement control signals for the movement system corresponding to the input when the input pertains to the movement system. The one or more movement control signals causing the movement system to change a position of the mirrored door. The memory further stores instructions to generate one or more light control signals for the controllable light sources when the voice input pertains to the controllable light sources. The light control signals modify a characteristic of light emitted from the controllable light sources.

DETAILED DESCRIPTION

Referring generally to the FIGURES, described herein is a storage cabinet. The storage cabinet includes a housing, a movement system, and a computing system. The housing includes a plurality of walls and a door, which together define an internal storage cavity. The movement system is configured to control movement of the door. The movement system includes a driver and a slider. The slider is coupled to the door and the driver. In operation, the driver drives the slider to move the door between a fully closed position and, at least, a fully open position. The computing system is configured to receive an input for moving the door, and generate control signals for the driver to move the door into a different position according to the input.

Various aspects described herein are designed to simplify movement of the storage cabinet. For instance, in some embodiments, a user may provide a voice input for moving the door into different positions (e.g., "open the door," "close the door," "open the door to 70%," etc.). In these embodiments, a microphone is provided to detect the voice input provided by the user. The computing system interprets the voice input and generates control signals for the movement system to move the door into the desired position.

In another aspect, side wings are arranged on opposing sides of the housing. Such side wings may be rotatably coupled to the housing (e.g., through hinges, for instance). The side wings may include respective controllable light sources. The user may provide inputs (such as being in proximity of the storage cabinets, providing voice inputs "turn on the lights," "turn off the lights," "dim the lights 50%," etc.) to change a characteristic of light emitted from the light sources. The computing system receives the input and generates control signals to the controllable light sources to change various characteristics of light emitted from the light sources according to the user input.

Figure 1B:
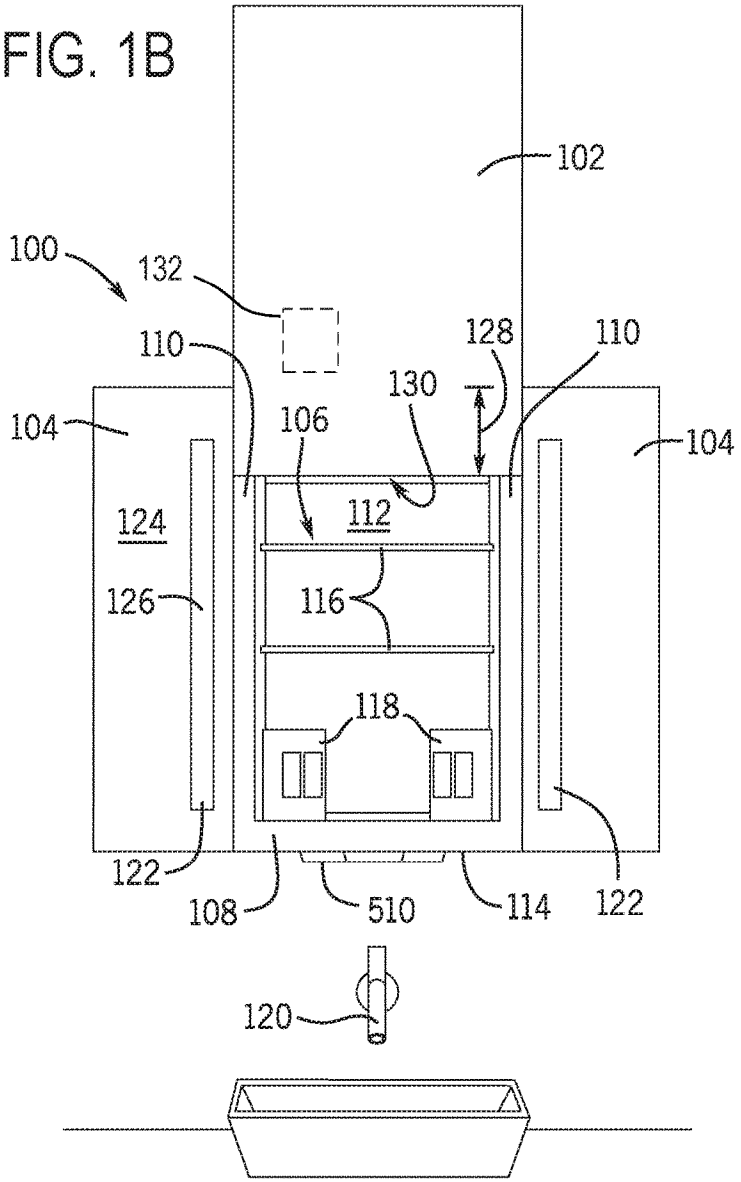
FIG. 1A and FIG. 1B show front views of a storage cabinet, according to an exemplary embodiment.
Figure 1A:
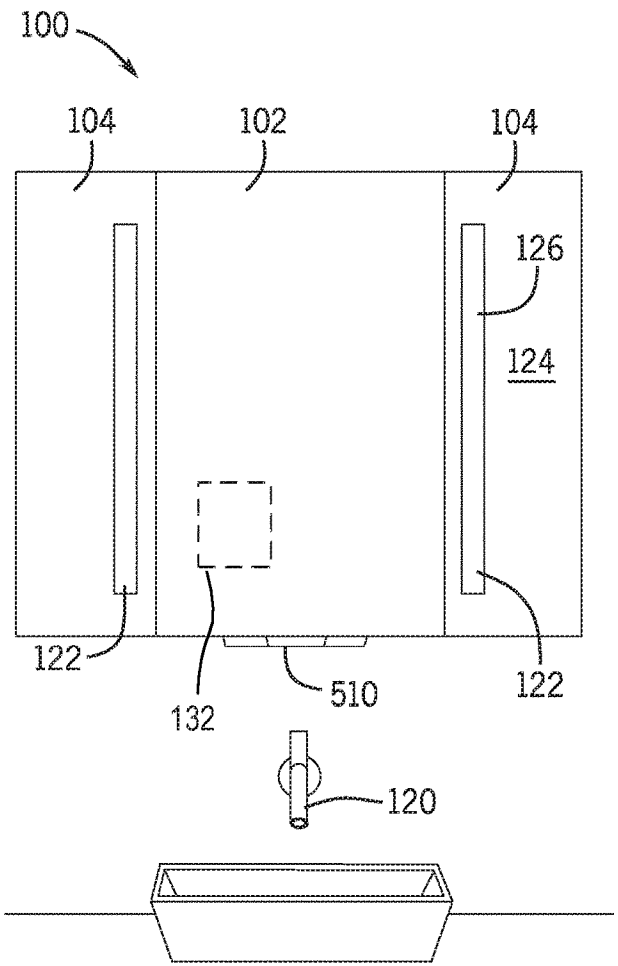

Referring now to FIG. 1A and FIG. 1B, front views of a storage cabinet 100 are shown, according to exemplary embodiments. The storage cabinet 100 is shown to include a center door 102 and a pair of opposing side wings 104. In some embodiments, the center door 102 and/or side wings 104 may be mirrored. For instance, the center door 102 and/or side wings 104 may include a transparent exterior surface covering a reflective material or film. In some implementations, the reflective material or film may span the exterior surface such that the entirety of the side wings 104 and/or center door 102 are mirrored. In other implementations, the reflective material or film may span an area that is less that the entirety of exterior surface. As one example, a center region of the center door 102 and/or side wings 104 may be mirrored while a perimeter of the center door 102 and/or side wings 104 may be frosted.

In some embodiments, the center door 102 may selectively cover an internal storage cavity 106. For instance, the storage cabinet 100 may include a housing 108. The housing 108 may include opposing side walls 110, a back wall 112, and a base 114. In combination, the side walls 110, back wall 112, base 114, and center door 102 may define the internal storage cavity 106. Thus, when the center door 102 is closed (shown in FIG. 1A), the internal storage cavity 106 may be closed. When the center door 102 is open (as shown in FIG. 1B), the internal storage cavity 106 may be exposed. The internal storage cavity 106 may include various shelving 116, outlets 118, etc.

In use, a user may store various personal products on the shelving 116, such as toiletry products, soap, toothbrushes and hair brushes, blow dryers, curling irons, etc. Additionally, some such personal products may require electrical power. These products may be selectively plugged into outlets 118 when used, and unplugged and stowed in the internal storage cavity 106 when not in use. The outlets 118 may be electrically coupled to and receive electrical power from a power supply. For example, in some embodiments, the power supply is a wall outlet or jack of a room in which the storage cabinet 100 is situated. In other embodiments, the power supply includes a battery or battery bank. In each of these implementations, the power supply may provide electrical power to the outlets 118 and other components subsequently described herein which may require electrical power for operation. In some implementations, the outlets 118 may include ground-fault circuit interrupter (GFCI) protection to prevent electrical shock to a user who may be using products which require electricity near a water source 120 such as a sink, shower, bathtub, for instance.

In some embodiments, the side wings 104 and/or center door 102 may include a light source 122. The light source(s) 122 may be arranged to emit light outwardly and perpendicular from the exterior surface of the side wings 104 and/or center door 102. As shown in FIG. 1A and FIG. 1B, in some embodiments, each of the respective side wings 104 may include light sources 122. In some implementations, the side wings 104 may include at least two portions 124, 126. One portion 124 for a respective side wing 104 may be more reflective than the other portion 126. The light source 122 may be arranged to project light through the less reflective portion 126. While described generally herein, the present disclosure contemplates various other arrangements for light sources in mirrors such as those described in U.S. patent application Ser. No. 15/863,409 filed on Jan. 5, 2018, titled "Light Engine for a Mirror," the contents of which are incorporated by reference in its entirety.

In some embodiments, the center door 102 may include a non-mirrored portion 132. The non-mirrored portion 132 may be sized to fit a screen, such as a screen of a tablet. As will be discussed in greater detail below, in some instances, the tablet may be positioned behind the non-mirrored portion 132 to provide visual feedback and other information to a user. The tablet may be movable between a visible and a non-visible position. In the visible position, the screen may be viewable through the non-mirrored portion 132. In the non-visible position, the interior of the storage cavity 108 may be viewable through the non-mirrored portion 132.

In some implementations, the light source(s) 122 may be controllable. For instance, the light source(s) 122 may include an array of light emitting diodes (LEDS). For example, in one embodiment, the light source 122 is a uniform (e.g., linear) array of white light-emitting LEDS emitting light having a fixed correlated color temperature (CCT). In other embodiments, the CCT of the emitted luminous flux is adjustable. In some embodiments, the light source(s) 122 include a number of individually-driven of multicolor LEDS rendering an overall color of the emitted luminous light adjustable by the user. In some embodiments, the light source(s) 122 emit a luminous flux of approximately 1300 lumens.

As will be discussed in greater detail below, a computing system 500 (of FIG. 5) may facilitate control of the light source(s) 122. The computing device may receive inputs from a user for modifying one or more characteristics of light emitted from the light source(s) 122. Such inputs may be voice inputs, tactile inputs, etc., which are provided by the user that are intended to modify a desired characteristic of the light emitted from the light source(s) 122. For instance, the computing device may be communicably coupled to the light source 122(*s*) and configured to provide control signals to individual elements (e.g., LEDS) of the light source 122 to control an overall light output of the light source(s) 122.

As shown in the transition between FIG. 1A and FIG. 1B, the center door 102 may be movable into different positions. More specifically, in the embodiment shown in FIG. 1A and FIG. 1B, the center door 102 may be vertically moved (e.g., raised and lowered along a vertical axis). The center door 102 may be lowered to a fully closed position (depicted in FIG. 1A) where the internal storage cavity 106 is concealed. Additionally, the center door 102 may be raised to a fully open position (depicted in FIG. 1B) where, at least, most of the internal storage cavity 106 is exposed. For instance, in the fully open position, a lower region 128 of the center door 102 may conceal an upper region 130 of the internal storage cavity 106. In some embodiments, various components and/or circuitry described herein may be stored or otherwise mounted in the upper region 130 of the internal storage cavity 106. Additionally or alternatively, various components and/or circuitry described herein may be mounted beneath the base 114 of the housing 108. In each of these implementations, these components/circuitry may be discreetly mounted such that the storage cabinet 100 may be more visually appealing to a user. While described as vertical movement, in some embodiments, the storage cabinet 100 may be configured for side-to-side movement of the center door 102. In still other embodiments, the storage cabinet 100 may be configured to pivotable movement (e.g., rotate or pivot the center door 102 between open and closed positions).

Figure 2:
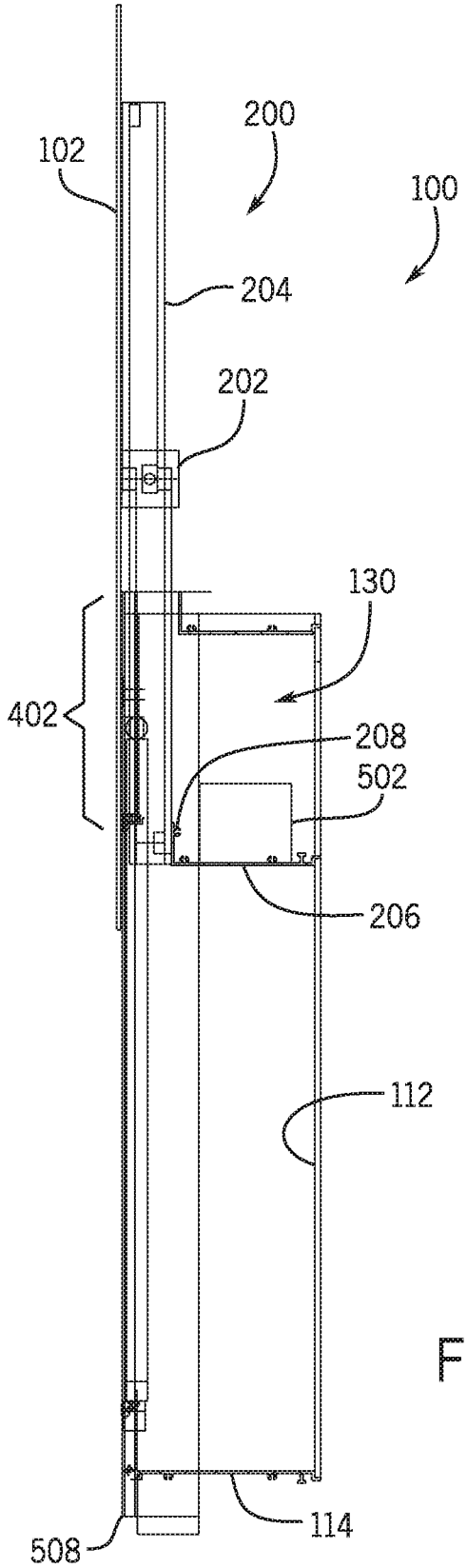
FIG. 2 shows a side view of the storage cabinet, according to an exemplary embodiment.

Referring now to FIG. 2, a side view of the storage cabinet 100 is shown, according to an exemplary embodiment. In some embodiments, the storage cabinet 100 can include a movement system 200. The center door 102 may be coupled to the movement system 200. The movement system 200 includes any component or group of components configured to move the center door 102 along an axis. While described as the vertical axis with respect to FIG. 1A and FIG. 1B, it should be understood that the storage cabinet 100 can be modified such that the movement system 200 moves the center door 102 in any direction. For instance, the movement system 200 may slide the center door 102 side-to-side with respect to the housing 108. Accordingly, the movement system 200 may provide for planar movement of the center door 102 with respect to the housing 108. Additionally, in some embodiments, the movement system 200 may provide for rotational or pivotable movement of the center door 102 with respect to the housing 108.

The movement system 200 is configured to move the center door 102 between the fully open position (shown in FIG. 1A) and fully closed position (shown in FIG. 1B). In some implementations, the movement system 200 is configured to move the center door 102 responsive to inputs provided by a user, as will be discussed in further detail below. Such inputs may be provided orally, via a button or touchpad, etc. In instances where the tablet is provided, such inputs may be provided on the tablet in the non-mirrored portion 132.

The movement system 200 includes a driver 202. The driver 202 may be configured to provide mechanical power to move (e.g., drive) one or more components of the movement system 200. For instance, the driver 202 may provide mechanical power to move various components of the movement system 200 which are operatively connected to the center door 102. The term "operatively connected," as used throughout this description, can include direct or indirect connections, including connections without direct physical contact. As such, the driver 202 may be controlled to provide movement of the center door 102 along an axis (e.g., planar movement). As will be discussed in greater detail below, control signals for the movement system 200 may be generated for controlling the movement of the center door 102. Such control signals may be generated based on a number of inputs from a user, such as voice input, tactile input, etc.

In embodiments where a tablet is provided, the tablet may move with the movement system 200. For instance, the tablet may move with the movement system 200 such that the screen is viewable through the non-mirrored portion 132 when the center door 102 is in both the fully open and fully closed position.

Figure 3:
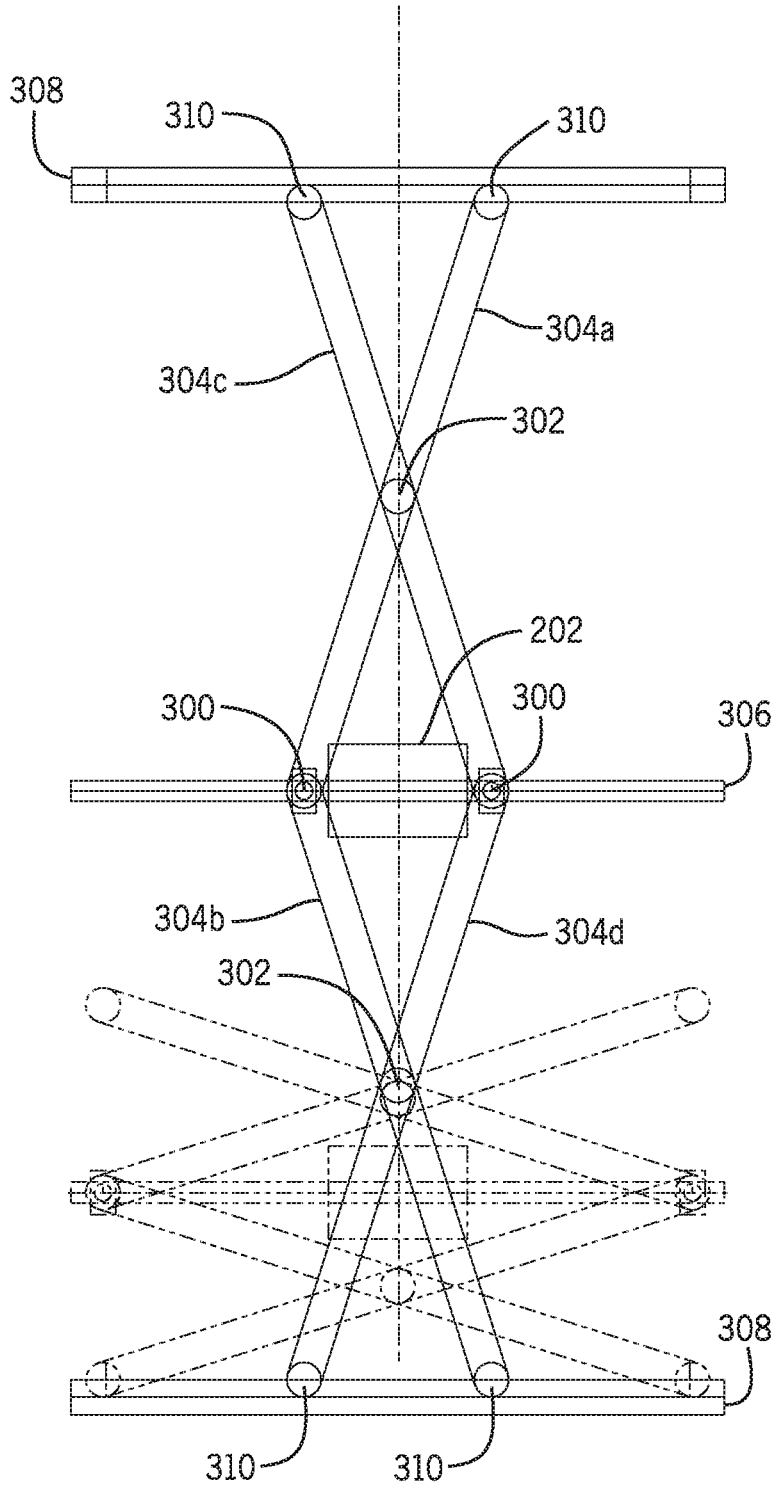
FIG. 3 shows a movement system for the storage cabinet, according to an exemplary embodiment.

Referring now to FIG. 2 and FIG. 3, according to one exemplary embodiment, the movement system 200 may include driver 202 and a scissor linkage 204. Specifically, an exemplary embodiment of the movement system 200 is shown in greater detail in FIG. 3. The scissor linkage 204 includes a plurality of joints 300 and linkages 302. The scissor linkage 204 may include a number of arms 304*a-d*. A first arm 304*a* may be serially connected to a second arm 304*b* via a joint 300. Additionally, the first arm 304*a* may be connected in parallel with an adjacent arm 304*c* via linkage 302. Arm 304*c* may be serially connected to a fourth arm 304*d* via a joint 300. Arms 304*a-d* may cooperatively move to change a height. The driver 202 may be arranged to change a distance D between joints 300. For instance, the driver 202 may be arranged on a screw 306. Additionally, the joints 300 may be arranged on the screw 306. The driver 202 may be configured to rotate the screw 306. The screw 306 may extend between the joints 300. As the screw 306 rotates, the joints 300 may move in cooperation along the screw 306. For instance, as the screw 306 rotates in one direction, the joints 300 may together move towards the center of the screw 306 (thus decreasing the distance D between the joints 300). Additionally, where the screw 306 rotates in the other direction, the joints 300 may together move away from the center of the screw 306 (thus increasing the distance D between the joints 300). As the distance D changes, the arms 304 rotate about linkage 302. Since the arms 304 coupled to screw 306 via joints 300, as the arms 304 rotate, the height H changes (according to the length of the arm 304 and angle between the arm 304 and screw 306). For instance, as the distance D between the joints decreases, the height H increases (shown in solid in FIG. 3). Additionally, as the distance D between the joints increases, the height H decreases (shown in phantom in FIG. 3).

The movement system 200 may include tracks 308 arranged at ends of the arms 304. Each arm 304 may include a roller 310. Each roller 310 may be positioned within a corresponding track 308. Accordingly, as the height H of the movement system 200 changes, the rollers 310 may cooperatively move along the tracks 308. In some implementations, the tracks 308 may include notches and the rollers 310 may include corresponding teeth. In implementations such as these, movement of the rollers 310 may be restricted, thus providing improved safety measures.

As shown in FIG. 2 and FIG. 3, the movement system 200 may be coupled to the center door 102. For instance, an upper track 308 may be attached to the back of the center door 102, and the lower track 308 may be attached to the housing 108. In some embodiments, the lower track 308 may be attached to the housing 108 within the concealed portion 126. As shown in FIG. 2, the housing 108 may include a ledge 206 extending outwardly from the back wall 112. Additionally, the ledge 206 may include a lip 208 extending upwardly and substantially parallel to the back wall 112. The lower track 308 may be coupled to the lip 208. Accordingly, as components of the movement system 200 moves along the axis shown, the center door 102 may move with the movement system 200 along the same axis. In some embodiments, the driver 202 may be pressed against the center door 102. For instance, one face of the driver 202 may be pressed against a backside of the center door 102. Additionally, padding may be sandwiched between the driver 202 and the backside of the center door 102. In embodiments such as these, rotation of the driver 202 may be inhibited due to the driver 202 being pressed against the center door 102.

Where the tablet is provided, the tablet may be movable through a movement system similar to movement system 200. Accordingly, the tablet may be moved with respect to the center door 102 via a corresponding movement system. While the above arrangement is described, the movement system for the tablet may be different. Additionally, while shown in the center door 102, in some embodiments, the tablet (and therefore the non-mirrored portion 132) may be positioned in one of the side wings 104.

Figure 4:
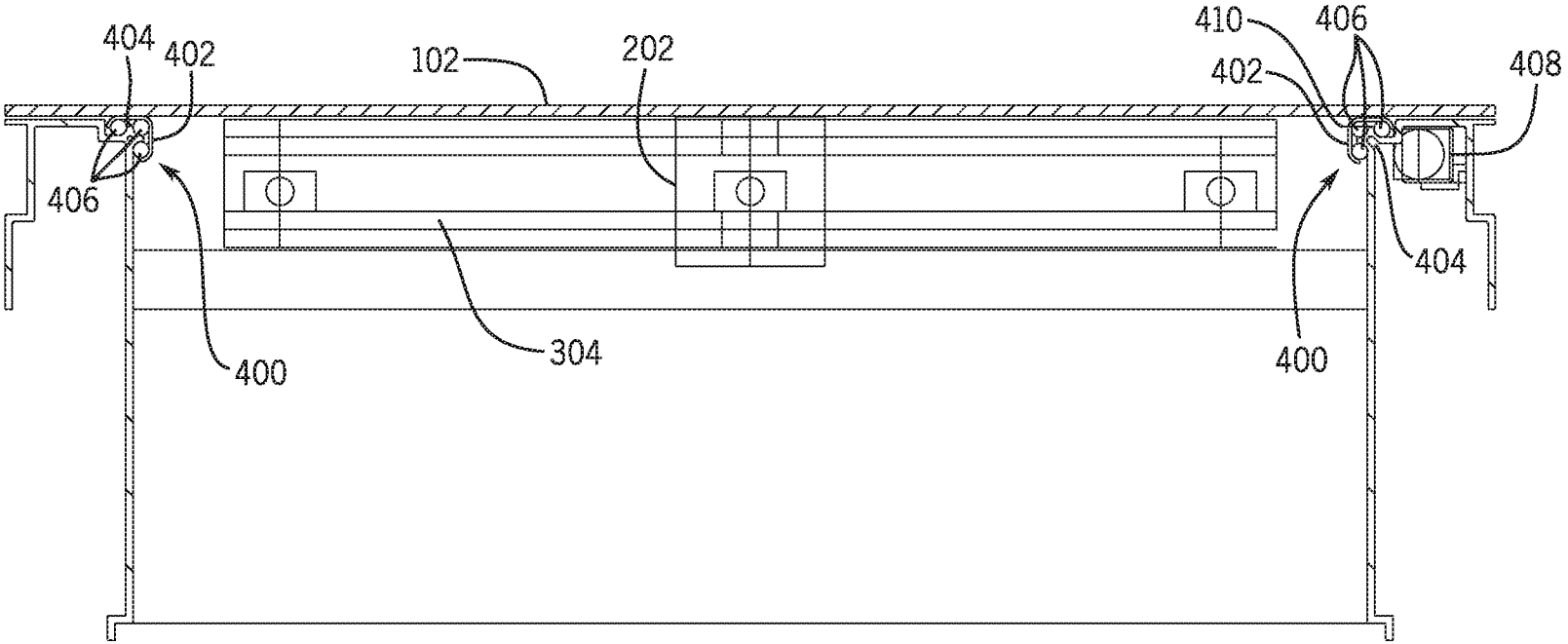
FIG. 4 shows a top view of the storage cabinet, according to an exemplary embodiment.

Referring now to FIG. 2 and FIG. 4, the storage cabinet 100 may include a railing system 400. Specifically shown in FIG. 4 is a top view of the storage cabinet 100 according to an exemplary embodiment. The railing system 400 may include a plurality of rail housings 402. While two are shown in FIG. 4, the railing system 400 may include more or less than two rail housings 402. As shown in the exemplary embodiment in FIG. 4, the rail housings 402 may be arranged on opposite sides of the center door 102. The rail housings 402 may extend substantially parallel to axis Y (e.g., along the length of the center door 102). Additionally, the side walls 110 may include a tracked portion 404. The rail housing 402 may be positioned around the tracked portion 404. Additionally, a number of bearings 406 may be sandwiched between the tracked portion 404 and rail housing 402. In some embodiments, the bearings 406 may be ball bearings. The tracked portion 404 may move along the rail housing 402 by rolling along the bearings 406. In some embodiments, the railing system 400 may be similar to railing systems used in drawers. For instance, the railing system 400 may be similar to arrangements described in U.S. Pat. No. 5,020,869 to Faust, titled "Drawer Runner for Drawers Preferably made of Plastic," and U.S. Pat. No. 6,142,020 to Schael et al., titled "Drawer Slide Assembly," the contents of each of which are incorporated by reference in their entirety.

In some embodiments, the storage cabinet 100 may include a counterweight 408. The counterweight 408 may be arranged proximate to either of the railing systems 400. The counterweight 408 may be arranged to balance the center door 102 and thereby maintain the center door 102 in an upright position.

It is noted that, while FIG. 2-FIG. 4 show one example of a movement system 200, many other examples are contemplated. For instance, the movement system 200 may include various drivers, gears, etc., which are arranged to change height H according to various inputs and driver controls. Another example of a movement system 200 may include various belts which are driven by a driver 202 (or series of drivers 202). For instance, the movement system 200 may include belts similar to those shown in U.S. Pat. No. 9,675,172 assigned to Robern, Inc., which is incorporated by reference in its entirety. The belts may be rotatably driven by a driver 202 to cause the center door 102 to move along axis Y.

Figure 5:
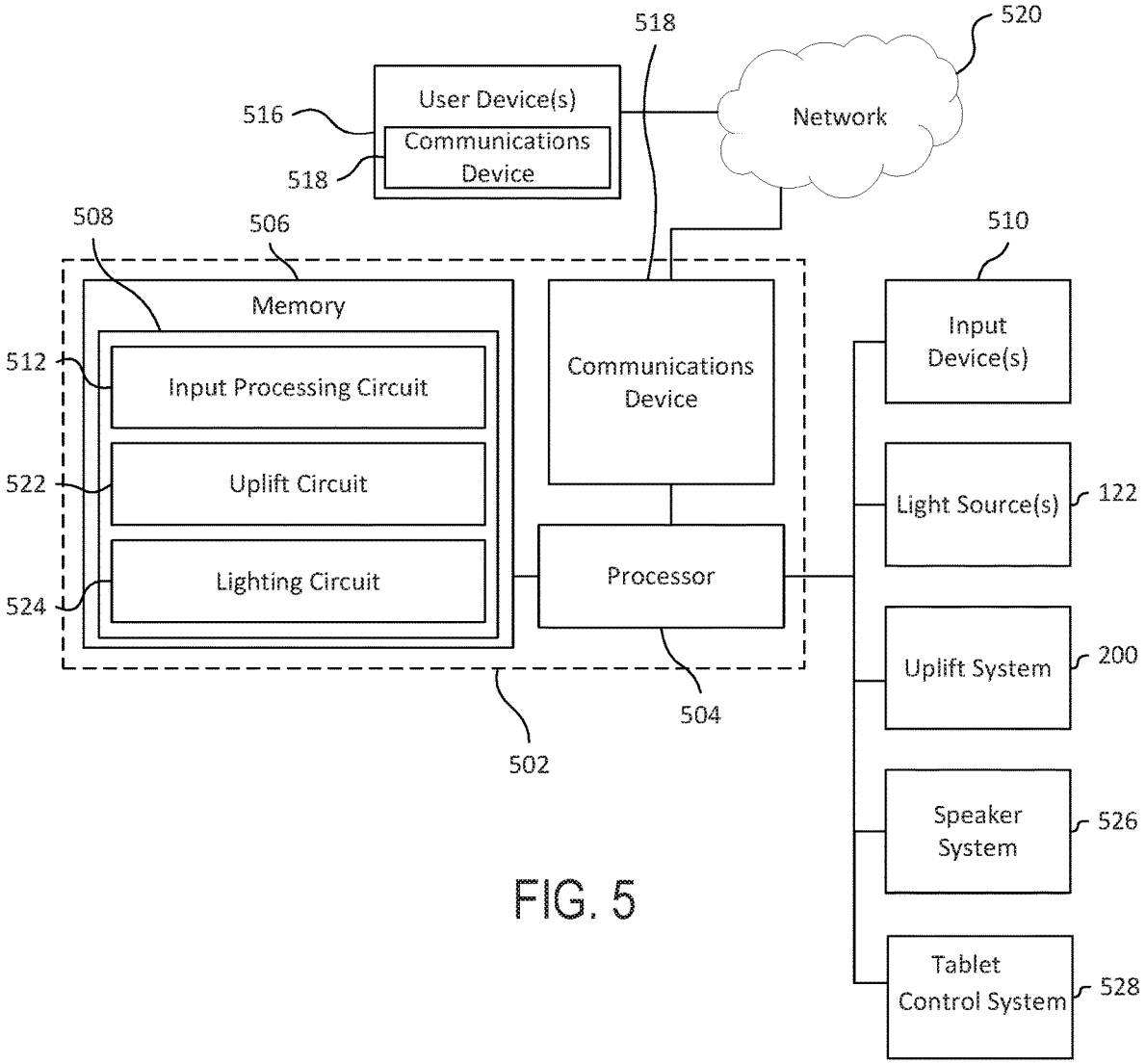
FIG. 5 shows a schematic diagram of a computing system for the storage cabinet, according to an exemplary embodiment.

Referring now to FIG. 5, a schematic diagram of a computing system 500 for the storage cabinet 100, according to an example embodiment. The computing system 500 is shown to include a computing device 502. The computing device 502 may include a processor 504 and memory 506. The computing device 502 may be powered via an external source (similar to outlets 118), powered via a battery or battery bank, etc. In embodiments where a tablet is included, the computing system 500 may be embodied on the tablet. Accordingly, the tablet may be functional for the user and also provide the computing functionality described herein. In other embodiments, the tablet may be functional for the user, and the storage cabinet 100 may include a dedicated computing system 500 separate from the tablet. In these embodiments, various channels and/or buses may be provided behind the center door 102 for electrically coupling the tablet to the dedicated computing system 500.

Processor 504 may be a general purpose or specific purpose processor, an application specific integrated circuit (ASIC), one or more field programmable gate arrays (FPGAs), a group of processing components, or other suitable processing components. Processor 504 may be configured to execute computer code or instructions stored in memory 506 or received from other computer readable media (e.g., CDROM, network storage, a remote server, etc.) to perform one or more of the processes described herein. Memory 506 may include one or more data storage devices (e.g., memory units, memory devices, computer-readable storage media, etc.) configured to store data, computer code, executable instructions, or other forms of computer-readable information. Memory 506 may include random access memory (RAM), read-only memory (ROM), hard drive storage, temporary storage, non-volatile memory, flash memory, optical memory, or any other suitable memory for storing software objects and/or computer instructions. Memory 506 may include database components, object code components, script components, or any other type of information structure for supporting the various activities and information structures described in the present disclosure. Memory 506 may be communicably connected to the processor 504 and may include computer code for executing (e.g., by processor, etc.) one or more of the processes described herein.

The memory 506 is described below as including various circuits 508. The circuits 508 can be or include one or more circuits which are used to generate output signals corresponding to an input and a configuration of the one or more circuits. Accordingly, the circuits 508 can dictate an output based on a format of the input and the configuration of the circuit 508. Circuits 508 can be configured in an arrangement so as to form an instruction (e.g., an instruction to generate an output based on the input). Accordingly, the circuits 508 can be one or more instructions that, when executed by the processor 504, cause the processor to perform various functions. While the exemplary embodiment shown in the figures shows each of the circuits 508 as being separate from one another, it should be understood that, in various other embodiments, the memory 506 may include more, less, or altogether different circuits 508. For example, the structures and functions of one circuit 508 may be performed by another circuit 508, or the activities of two circuits 508 may be combined such that they are performed by only a signal circuit 508. Additionally, it should be understood that any of the functionalities described as being performed by a circuit 508 that is a part of the computing device 502 may also be performed by a separate hardware component having its own processors, network interfaces, etc.

The computing system 500 may include one or more input devices 510. The input device(s) 510 may be any devices/components or group of devices/components configured to generate signals corresponding to inputs from a user. Such input may be transformed by the input device(s) 510 into a corresponding signal which may be distributed or otherwise communicated to one or more other components within the computing system 500. In some embodiments, the input device(s) 510 may include a microphone configured to receive voice inputs from a user, which may in turn be used for generating microphone signals. In some embodiments, the input device(s) may include one or more buttons, a touch screen, or other tactile input device configured to receive touch inputs from a user, which may in turn be used for generating tactile signals. In some embodiments, the input device(s) may include a proximity sensor configured to detect a presence of the user, which may in turn be used for generating proximity signals.

Referring briefly to FIG. 3 and FIG. 5, in some embodiments, one or more components of the computing system 500 may be housed locally within the storage cabinet 100. For instance, some components may be located in the upper region 130 (e.g., on the ledge 206), and some components may be mounted beneath the base 114 of the housing 108. As one example, the input device(s) 510 may be mounted beneath the base 114 (also as shown in FIG. 1A and FIG. 1B). Additionally, the computing device 502 may be mounted within the storage cabinet 100 atop the ledge 206. Note that, while the computing device 502 is shown as being stored locally, the computing device 502 may be stored remotely and be accessible (e.g., via various communication devices/systems) to perform various functions described herein and to control various devices/components described herein.

Referring to FIG. 5, in some embodiments, the circuits 508 included in memory 506 may include an input processing circuit 512. The input processing circuit 512 can be or include instructions that, when executed by the processor 504, cause the processor 504 to identify an input based on data received from the input device(s) 510. The input device(s) 510 may generate data or signals (e.g., microphone signals, tactile signals, proximity signals, etc.), which are then communicated to the processor 504. The processor 504 may receive those signals from the input device(s) 510 and process the signals according to the instructions from the input processing circuit 512.

In embodiments where the data/signals include microphone data/signals, the input processing circuit 512 may include instructions for performing various speech recognition and natural language understanding steps. For instance, the input processing circuit 512 may include instructions for converting the microphone signal (corresponding to the spoken input) into text (by using various look-up tables, dictionaries, etc.). Such conversion may be performed following filtering of the microphone signal. Once the microphone signal is converted into text, the text may be used for performing natural language understanding on the text. Such natural language understanding may be used for identifying a "meaning" of the input. Natural language understanding may be performed using semantic models, context, etc. An input may be derived from the microphone signal based on the natural language understanding.

In embodiments where the data/signals include tactile signals and/or proximity signals, the input processing circuit 512 may include instructions for using the tactile input for directly generating one or more inputs to the various systems/components described herein. Note that, where the input is generated by an input device 510 for receiving spoken inputs (e.g., a microphone), the meaning of the input is derived—whereas, where the input is generated by a input device 510 for receiving tactile or proximity inputs (e.g., touch screen, button(s), proximity sensor), the input is typically a one-to-one relationship to the output.

In some embodiments, the computing system 500 may include one or more user device(s) 516. The user device(s) 516 may include a mobile device or smart phone associated with the user, a personal computer or laptop associated with the user, a personal assistant associated with the user (e.g., a personal assistant from APPLE®, GOOGLE®, AMAZON®, etc.). The user device(s) 516 may be used by the user for controlling various component(s) of the storage cabinet 100. For instance the user device(s) 516 may communicate with the computing device 502 via a network. In some embodiments, both the user device(s) 516 and computing device 502 may include respective communications devices 518. The communications device(s) 518 can be or include components configured to transmit and/or receive data from one or more remote sources. Each of the respective communications devices 518 may permit or otherwise enable data to be exchanged between the user and the computing device 502. The communications device 518 may communicate via a network 520. The network 520 may be a Local Area Network (LAN), a Wide Area Network (WAN), a Wireless Local Area Network (WLAN), an Internet Area Network (IAN) or cloud-based network, etc. In some implementations, the communications device(s) 518 may access the network 520 to exchange data with various other communications device(s) 518 via cellular access, a modem, broadband, Wi-Fi, satellite access, etc. In embodiments such as these, the input processing circuit 512 may include instructions to determine, based on a signal received from the user device(s) 516 via communications device 518 for the computing device 502, an input from the user. Such instructions may include reformatting or otherwise interpreting the signal generated by the user device(s) 516 to determine the input from the user.

Once the input from the user is determined using the input processing circuit 512, one or more of the components of the storage cabinet 100 may be controlled. For instance, the light source(s) 122 may be controlled. Additionally, the movement system 200 may be controlled. The light source(s) 122 and/or the movement system 200 may be communicably coupled the processor 504. Accordingly, the processor 504 may generate signals for the light source(s) 122 to control one or more characteristics of light emitted from the light source(s) 122. Additionally, the processor 504 may generate signals for the movement system 200 to control movement of the center door 102. The input processing circuit 512 may include instructions to determine which component of the storage cabinet 100 is to be controlled based on the input. For instance, the signal received from the input device(s) 510 may be received by the processing circuit 512 and used for determining whether the signal corresponds to the movement system 200 or the light sources(s) 122. Each signal may have corresponding characteristics depending on which of the movement system 200 and light source(s) 122 are to be controlled.

In some embodiments, the circuits 508 included in memory 506 may include a movement circuit 522. The movement circuit 522 can be or include instructions that, when executed by the processor 504, cause the processor 504 to generate one or more movement control signals for the movement system 200 based on the input determined via the input processing circuit 512. The movement circuit 522 may include instructions for generating movement control signals for the driver 202 that cause the driver 202 to change the height H. For instance, where the user provides an input for opening the center door (e.g., by stating "open the center door," by providing a corresponding tactile input, etc.), the movement circuit 522 can include instructions for generating movement control signals for the driver 202 to increase the height H to the maximum height (e.g., by decreasing the distance D between joints 300 to the minimum distance D). As another example, where the user provides an input for closing the center door (e.g., by stating "close the center door," by providing a corresponding tactile input, etc.), the movement circuit 522 can include instructions for generating movement control signals for the driver 202 to decrease the height H to the minimum height (e.g., by increasing the distance D between joints 300 to the maximum distance D). In each of these implementations, the instructions may include identifying a current position of the center door 102, determining a direction of rotation of the driver 202, and causing the driver 202 to rotate in the determined direction. The movement circuit 522 may include instructions to measure an amount of rotation of the driver 202. Data corresponding to an amount of rotation required for moving the center door 102 between a fully open and fully closed position may be stored in memory 506. The measured rotation of the driver 202 may be compared to the data stored on memory 506. When the measured rotation indicates that the center door 102 is in the fully open (or fully closed) position, the movement circuit 522 may include instructions for stopping rotation of the driver 202.

In some embodiments, the user may provide an input for moving the center door 102 to an intermediate position between the fully open position and fully closed position. For instance, the user may provide a tactile input that corresponds to incrementally lifting (or lowering) the center door 102. The movement circuit 522 may include instructions to incrementally raise (or lower) the center door 102 based on the tactile inputs from the user until the center door reaches the maximum (or minimum) position (e.g., a fully open or fully closed position). As another example, the user may provide a voice input that corresponds to moving the center door 102 to a specific intermediate position (for instance, "open the center door 70%," "open the center door a third," etc.). The movement circuit 522 may include instructions to move the center door 102 to the specific intermediate position indicated by the voice input. Similar to moving the center door 102 to a fully open or fully closed position, the instructions may include identifying a current position of the center door 102, determining a direction of rotation of the driver 202, and causing the driver 202 to rotate in the determined direction. The movement circuit 522 may include instructions to measure an amount of rotation of the driver 202. Data corresponding to an amount of rotation required for moving the center door 102 between a fully open and fully closed position may be stored in memory 506. Specifically where the input is to move the center door 102 to an intermediate position, the data may be used for determining an amount of rotation of the driver 202 to position the center door 102 in the intermediate position. As one non-limiting example, where the input is to open the center door 102 to 70%, the amount of rotation required for moving the center door 102 to 70% may be 70% of the amount of rotation needed to move the center door 102 from the fully closed to the fully open position (and 30% of the amount of rotation needed to move the center door from the fully open to the fully closed position). When the measured rotation indicates that the center door 102 is in the intermediate position from the input, the movement circuit 522 may include instructions for stopping rotation of the driver 202.

In some embodiments, the circuits 508 included in memory 506 may include a lighting circuit 524. The lighting circuit 524 can be or include instructions that, when executed by the processor 504, cause the processor 504 to generate one or more light control signals for the light source(s) 122 based on the input determined via the input processing circuit 512.

In some embodiments, where the input device(s) 510 include a proximity sensor, the proximity sensor may generate data indicating the presence of the user. When the presence of the user is detected (via the proximity sensor), the lighting circuit 524 may include instructions to generate one or more light control signals for activating at least some of the light source(s) 122 and thereby illuminate the light source(s) 122. Additionally, where the presence of the user is not detected (or not detected for a default amount of time), the lighting circuit 524 may include instructions to generate one or more light control signals for deactivating at least some of the light source(s) 122 and thereby dim (or turn off) the light source(s) 122.

In some embodiments, where the input device(s) 510 is a tactile input device (e.g., a button, touch screen, etc.), the tactile input device may generate data corresponding to a tactile input from the user. The user may select a button, swipe, press or select a specific area of a touch screen, etc. Each of these inputs provided by the user may have corresponding outputs (e.g., a specific button/location/swipe pattern may turn on/off the light source(s) 122, dim or brighten the light source(s) 122, change a warmth or coolness of light emitted from the light source(s) 122, etc.).

The tactile input device may generate data corresponding to each of these tactile inputs when received from the user. The lighting circuit 524 may include instructions for generating light control signals to turn on/off the light source(s) 122, dim or brighten the light source(s) 122, change a warmth or coolness of light emitted from the light source(s) 122, etc. In various embodiments, the light source(s) 122 includes an array of light emitting diodes (LEDS). For example, in one embodiment, the light source(s) 122 is a uniform (e.g., linear) array of white light-emitting LEDS emitting light having a fixed correlated color temperature (CCT). In other embodiments, the CCT of the emitted luminous flux is adjustable. In some embodiments, the light source(s) 122 include a number of individually-driven of multicolor LEDS rendering an overall color of the emitted luminous light adjustable by the user. In some embodiments, the light source(s) 122 emit a luminous flux of approximately 1300 lumens.

The lighting circuit 524 may include instructions to provide light control signals to individual elements (e.g., LEDS) of the light source(s) 122 to control an overall light output of the light source(s) 122. For example, in some embodiments, the processor 504 provides signals to various LEDS of the light source(s) 122 that control the dimming of the LEDS via pulse-width modulation (PWM). In some embodiments, the processor 504 is a multi-channel device enabling aspects (e.g., color, CCT, etc.) of the luminous flux emitted via the light source(s) 122 to be adjusted. For example, in one embodiment, the CCT of light emitted from the light source(s) 122 is adjustable between 2200 k and 6500 k. In some embodiments, the color rending index of the light source(s) 122 is approximately 90, providing a fixed or adjustable CCT output at a power rating of greater than 45 lumens/watt.

In some embodiments, the storage cabinet 100 may include a speaker system 526. The speaker system 526 may include one or more speakers that may be positioned or otherwise mounted in the upper region 130 (e.g., on the ledge 206). In embodiments such as these, the storage cabinet 100 may be associated with a music account for a user. The user may generate an input for playing music on the speakers (e.g., similar to personal assistant devices from APPLE®, GOOGLE®, AMAZON®, etc.). The processor 504 may generate a signal to communicate to various sources associated with the music account (e.g., remote servers, for instance). The signal may be communicated via the communications device 518 to the source associated with the music account. The source may then communicate music data to the communications device 518, which can then be used for generating speaker signal(s) for the speakers to disburse sound corresponding to the music data. Additionally, where the speaker system 526 is included in the storage cabinet 100, the user may be able to change the volume (or other sound characteristics), listen to the radio, place phone calls, etc. Such features may be implemented by incorporating various components/circuitry as needed.

In some embodiments, where the storage cabinet 100 includes a tablet, the storage cabinet 100 may also include a tablet control system 528. The tablet control system 528 may be embodied on the tablet. In other embodiments, the tablet control system 528 may be separate from the tablet (e.g., embodied on other aspects of the computing system 500). The tablet control system 528 may receive feedback from a user. For instance, the above-described user inputs may be provided to the tablet via the tablet control system 528. Such inputs may be routed to the tablet via the tablet control system 528. The tablet may provide various features to the user by the user providing corresponding inputs. For instance, the user may access various information, such as news, weather, traffic, etc., on the tablet by providing corresponding inputs to the tablet control system 528. The tablet control system 528 may then route these inputs to the tablet. The corresponding information may be provided on the display for the tablet, and may be viewable by the user through the non-mirrored portion 132. Accordingly, the aspects described herein may further increase user enjoyment of the storage cabinet 100 by providing various types of information to the user as requested.

In some embodiments, the tablet control system 528 may control the movement system 200 described above. Additionally, the tablet control system 528 may control the movement system for the tablet. For instance, the user may provide a corresponding input to move the tablet into visible or non-visible portions. The movement system may move the tablet based on the inputs provided by the user. In some embodiments, the user may provide inputs similar to those described above for moving the center door 102 for moving the tablet (e.g., "move the tablet up," "move the tablet down," "I want to see the tablet," etc.). The tablet may correspondingly move into or out of the non-mirrored portion 132 via the movement system for the tablet.

Figure 6:
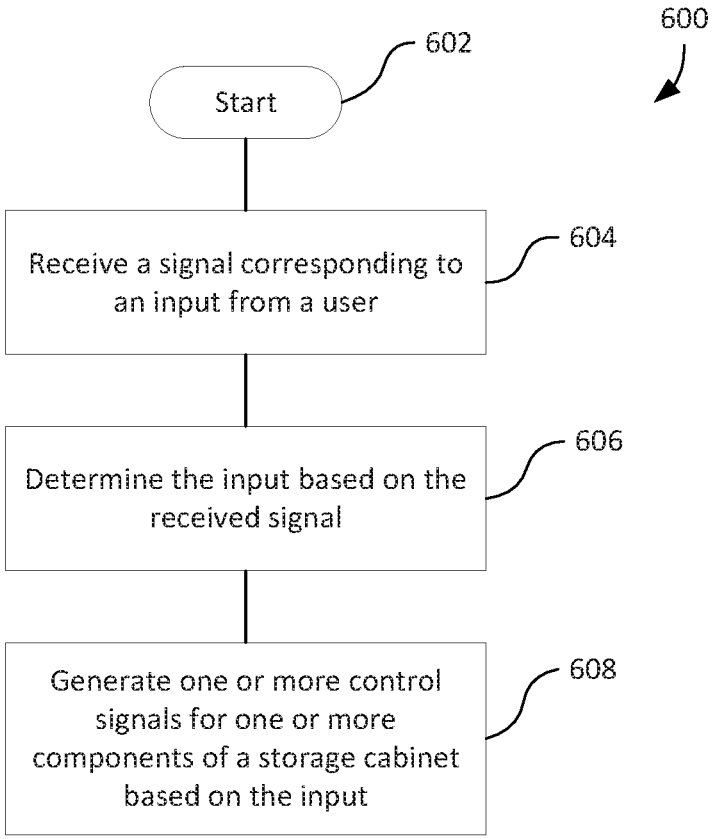
FIG. 6 shows a flow chart depicting a method of controlling one or more components of the storage cabinet, according to an exemplary embodiment.

Now that various aspects of the disclosed systems and components have been described, a method 600 of controlling one or more components of a storage cabinet 100 is disclosed with reference to the flow chart shown in FIG. 6. The flow chart shown in FIG. 6 provides only one example of controlling one or more components of a storage cabinet 100. Accordingly, the following disclosure should not be limited to each and every operation shown in FIG. 6. To the contrary, the method does not require each and every operation shown in FIG. 6. In some examples, the method may include additional operations. Further, the method does not need to be performed in the same chronological order shown in FIG. 6.

The method 600 may include a starting block 602. At starting block 602, the method 600 may begin. The method 600 may begin when electrical power is provided to one or components of the storage cabinet 100. The method 600 may begin when an electrical system (e.g., including any components requiring electrical energy) is turned on by a user. The method 600 may continue to operation 604.

At operation 604, the method 600 may include receiving a signal corresponding to an input from a user. The input from the user may be based on a signal received from one or more input device(s) 510 and/or the user device(s) 516. The processor 504 may receive a signal from, for instance, the input device(s) 510, the user device(s) 516, etc., corresponding to the input provided by the user. The method 600 may continue to operation 606.

At operation 606, the method 600 may include determining the input based on the signal received by the processor 504. The input processing circuit 512 may include instructions for identifying the input. The input processing circuit 512 can include instructions for analyzing the signal received from the input device(s) 510 and/or user device(s) 516 to determine the input. Such analysis may include voice-to-text, natural language processing, etc. Such analysis may include determining the output which corresponds to the specific input provided by the user. The method 600 may continue to operation 608.

At operation 608, the method 600 may include generating one or more control signals based on the input determined at operation 606. The control signals may be generated for the light source(s) 122, the movement system 200, speaker system 526, etc. Such control signals may be used for controlling the light source(s) 122, movement system 200, speaker system 526, etc. according to the input provided by the user. For instance, the control signals may turn on/off, dim/brighten, modify a warmth, etc. of the light source(s) 122, open/close the center door 102 via the movement system 200, play music on speaker(s) within the speaker system 526, change a volume (or other characteristic) of sound disbursed from speaker(s) within the speaker system 526, place a phone call via the speaker system 526 and microphone(s), etc.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the mirror assembly as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" or as an "example" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A storage cabinet comprising:

a housing including a plurality of walls and a door, the plurality of walls and the door defining an internal storage cavity;

a movement system operatively connected to the door and configured to control movement of the door, the movement system configured to move the door between a fully closed position and, at least, a fully open position based on inputs provided by a user;

a computing device operatively connected to the movement system, the computing device including a processor and memory, the memory storing instructions that, when executed by the processor, cause the processor to: receive an input from a user; and generate one or more control signals for the movement system based on the input from the user, the one or more control signals causing the movement system to move the door into a different position; and an outlet positioned within the internal storage cavity for providing electrical power to one or more personal electronic devices, the outlet receiving power from a source outside the outer housing.

2. The storage cabinet of claim 1, wherein the movement system comprises:

a scissor linkage including at least two joints arranged along a screw; and a driver arranged to rotate the screw, wherein, as the screw rotates, the distance between the at least two joints is changed and thereby a height of the scissor linkage is correspondingly changed, wherein a portion of the scissor linkage is attached to the door and a portion of the linkage is attached to the housing.

3. The storage cabinet of claim 2, wherein the scissor linkage further comprises:

first and second tracks positioned at both ends of the scissor linkage; and rollers attached to ends of the scissor linkage and positioned within corresponding tracks, wherein one of the first and second track is attached to the door and the other track is attached to the housing.

4. The storage cabinet of claim 1, wherein the input from the user corresponds to an instruction to move the door to an intermediate position between the fully open and the fully closed position, and wherein the one or more control signals for the movement system causes the movement system to move the door to the intermediate position.

5. The storage cabinet of claim 1, wherein the storage cabinet further comprises:

a speaker system operatively connected to the computing device, the speaker system including at least one speaker positioned within the storage cabinet, and wherein the memory further stores instructions to:

receive, via a communications device operatively connected to a source, music data from the source corresponding to a music account associated with the user; and control the speaker to disburse sound corresponding to the music data.

6. The storage cabinet of claim 1, further comprising:

a pair of opposing mirrored wings rotatably coupled to opposing sides of the housing, each mirrored wing having a controllable light source.

7. A storage cabinet comprising:

a housing including a plurality of walls and a door, the plurality of walls and the door defining an internal storage cavity;

a movement system operatively connected to the door and configured to control movement of the door, the movement system configured to move the door between a fully closed position and, at least, a fully open position based on inputs provided by a user;

a computing device operatively connected to the movement system, the computing device including a processor and memory, the memory storing instructions that, when executed by the processor, cause the processor to: receive an input from a user; and generate one or more control signals for the movement system based on the input from the user, the one or more control signals causing the movement system to move the door into a different position; and a pair of opposing mirrored wings rotatably coupled to opposing sides of the housing, each mirrored wing having a controllable light source.

8. The storage cabinet of claim 7, wherein the controllable light sources are coupled to the computing device, and wherein the memory stores instructions to:

receive a second input from the user corresponding to the controllable light sources;

generate one or more light control signals for the controllable light sources based on the second input from the user, wherein the light control signals modify a characteristic of light emitted from the controllable light sources.

9. A storage cabinet comprising:

a housing including a plurality of walls and a door, the plurality of walls and the door defining an internal storage cavity;

a movement system operatively connected to the door and configured to control movement of the door, the movement system configured to move the door between a fully closed position and, at least, a fully open position based on inputs provided by a user;

a computing device operatively connected to the movement system, the computing device including a processor and memory, the memory storing instructions that, when executed by the processor, cause the processor to:

receive an input from a user; and generate one or more control signals for the movement system based on the input from the user, the one or more control signals causing the movement system to move the door into a different position, wherein the movement system is configured to provide up-and-down movement with respect to the housing.

10. A storage cabinet comprising:

a housing including a plurality of walls and a mirrored door, the plurality of walls and the mirrored door defining an internal storage cavity;

a pair of opposing mirrored wings coupled to opposing sides of the housing; and a movement system configured to control planar movement of the mirrored door with respect to the internal storage cavity, the movement system configured to move the mirrored door between a fully closed position and, at least, a fully open position; and a computing device comprising a processor and memory, the memory storing instructions that, when executed by the processor, cause the processor to:

receive an input from a user to move the mirrored door into a different position than a current position of the mirrored door; and generate one or more control signals for the movement system to move the mirrored door from the current position towards the different position.

11. The storage cabinet of claim 10, further comprising:

a microphone communicably coupled to the computing system and arranged to detect voice inputs from the user, wherein the input received from the user is a voice input.

12. The storage cabinet of claim 10, wherein the movement system comprises:

a scissor linkage including at least two joints arranged along a screw; and a driver arranged to rotate the screw, wherein, as the screw rotates, the distance between the at least two joints is changed and thereby a height of the scissor linkage is correspondingly changed, wherein a portion of the scissor linkage is attached to the door and a portion of the linkage is attached to the housing.

13. The storage cabinet of claim 10, wherein the mirrored wings each include a respective controllable light source, the computing device is electrically coupled to the controllable light sources, and wherein the memory stores instructions to:

receive a second input from the user corresponding to the controllable light sources;

generate one or more light control signals for the controllable light sources based on the second input from the user, wherein the light control signals modify a characteristic of light emitted from the controllable light sources.

14. The storage cabinet of claim 10, wherein the input from the user corresponds to an instruction to move the door to an intermediate position between the fully open and the fully closed position, and wherein the one or more control signals for the driver causes the driver to move the door to the intermediate position.

15. The storage cabinet of claim 10, wherein, when the mirrored door is in the fully open position, a portion of the mirrored door conceals a region of the internal storage cavity.

16. The storage cabinet of claim 15, wherein the computing device is mounted in the concealed region of the internal storage cavity.

17. A storage cabinet comprising:

a housing including a plurality of walls and a mirrored door, the plurality of walls and the mirrored door defining an internal storage cavity;

a pair of opposing mirrored wings coupled to opposing sides of the housing, each of the mirrored wings including a respective controllable light source, a movement system operatively connected to the door and configured to control planar movement of the door, the movement system configured to move the door between a fully closed position and, at least, a fully open position based on inputs provided by a user; and a computing device communicably coupled to the controllable light sources and the movement system, the computing device including a processor and memory, the memory storing instructions that, when executed by the processor, cause the processor to:

receive an input from the user;

determine whether the input pertains to the movement system or the controllable light sources;

generate one or more movement control signals for the movement system corresponding to the input when the input pertains to the movement system, the one or more movement control signals causing the movement system to change a position of the mirrored door; and generate one or more light control signals for the controllable light sources when the voice input pertains to the controllable light sources, the light control signals modifying a characteristic of light emitted from the controllable light sources.

18. The storage cabinet of claim 17, wherein the input from the user pertains to the movement system and corresponds to an instruction to move the mirrored door to an intermediate position between the fully open and the fully closed position, and wherein the one or more movement control signals causes the movement system to move the mirrored door to the intermediate position.

19. The storage cabinet of claim 17, wherein, when the mirrored door is in the fully open position, a portion of the mirrored door conceals a region of the internal storage cavity, and wherein the computing device is mounted in the region concealed by the portion of the mirrored door region of the internal storage cavity.

20. The storage cabinet of claim 17, further comprising an input device for receiving the input from the user, wherein the input device is mounted along a base of the housing.

* * * * *